US009821343B2

(12) United States Patent
Oki et al.

(10) Patent No.: US 9,821,343 B2
(45) Date of Patent: Nov. 21, 2017

(54) PARTICLE SORTING MACHINE

(71) Applicant: NATIONAL INSTITUTE OF ADVANCED INDUSTRIAL SCIENCE AND TECHNOLOGY, Tokyo (JP)

(72) Inventors: Tatsuya Oki, Ibaraki (JP); Tomohiro Noguchi, Ibaraki (JP)

(73) Assignee: NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 61 days.

(21) Appl. No.: 14/387,428

(22) PCT Filed: Feb. 7, 2013

(86) PCT No.: PCT/JP2013/052808
§ 371 (c)(1),
(2) Date: Dec. 12, 2014

(87) PCT Pub. No.: WO2013/145871
PCT Pub. Date: Oct. 3, 2013

(65) Prior Publication Data

US 2015/0231669 A1 Aug. 20, 2015

(30) Foreign Application Priority Data

Mar. 28, 2012 (JP) ..... 2012-073607

(51) Int. Cl.
*B07B 4/00* (2006.01)
*B07B 4/02* (2006.01)
(Continued)

(52) U.S. Cl.
CPC ..... *B07B 4/02* (2013.01); *B07B 4/00* (2013.01); *B07B 7/00* (2013.01); *B07B 7/01* (2013.01);
(Continued)

(58) Field of Classification Search
CPC ..... B04C 2009/007; B07B 4/00; B07B 4/02; B07B 7/00; B07B 7/01; B07B 11/04
(Continued)

(56) References Cited

U.S. PATENT DOCUMENTS 2,386,975 A * 10/1945 Pearce ..... B07B 7/04 209/139.1
4,010,096 A * 3/1977 Murray ..... B07B 4/02 209/139.1
(Continued)

FOREIGN PATENT DOCUMENTS

EP 0145601 A1 6/1985
JP 50-139477 U 5/1974
(Continued)

OTHER PUBLICATIONS

Notice of Reason for Rejection issued in the corresponding Japanese Patent Application No. JP 2014-507486 by the Patent Office of Japan dated Oct. 6, 2015. (With English Translation).
(Continued)

*Primary Examiner* — Joseph C Rodriguez
*Assistant Examiner* — Kalyanavenkateshware Kumar
(74) *Attorney, Agent, or Firm* — Pergament & Cepeda LLP; Milagros A. Cepeda; Edward D. Pergament

(57) ABSTRACT

An airflow separator of the present invention includes: a first column into which gas is introduced from a lower portion and inside which a sample is made to flow; a heavy particle recovery device provided at the lower portion of the first column; and a control device configured to control a wind
(Continued)

speed by an amount of gas to be introduced into the first column. The first column has a weak rotational airflow generation mechanism to smooth wind speed distribution in a cross-section of a tube of the first column by making it substantially W-shaped from a portion of a wall of the tube to the center of the tube to another portion of the wall of the tube. The heavy particle recovery device recovers from the sample, heavy particles falling down. The airflow separator recovers emission gas, intermediate and light particles from an upper portion of the first column.

8 Claims, 7 Drawing Sheets

(51) Int. Cl.

| | |
|---|---|
| ***B07B 7/00*** | (2006.01) |
| ***B07B 7/01*** | (2006.01) |
| *B04C 9/00* | (2006.01) |
| *B07B 11/04* | (2006.01) |

(52) U.S. Cl.
CPC ..... *B04C 2009/007* (2013.01); *B07B 11/04* (2013.01)

(58) Field of Classification Search
USPC ..... 209/28, 29, 138, 139.1, 154
See application file for complete search history.

(56) References Cited

U.S. PATENT DOCUMENTS

| | | | | |
|---|---|---|---|---|
| 4,010,097 | A * | 3/1977 | Murray | B07B 4/02 209/139.1 |
| 4,127,476 | A * | 11/1978 | Iannazzi | B03B 4/06 209/138 |
| 4,568,453 | A * | 2/1986 | Lowe, Jr. | B07B 11/04 209/135 |
| 5,411,142 | A * | 5/1995 | Abbott | B07B 4/02 209/139.1 |
| 5,794,786 | A | 8/1998 | Arai et al. | |
| 6,405,405 | B1 * | 6/2002 | Hauch | B07B 11/04 15/309.2 |

FOREIGN PATENT DOCUMENTS

| | | | |
|---|---|---|---|
| JP | 02-211282 | A | 8/1990 |
| JP | 2535778 | B2 | 9/1996 |
| JP | 2757333 | B2 | 5/1998 |
| JP | 2913034 | B1 | 6/1999 |
| JP | 2005-205282 | A | 8/2005 |
| JP | 4096101 | B2 | 6/2008 |
| JP | 4122438 | B2 | 7/2008 |
| JP | 2010-214352 | A | 9/2010 |
| JP | 2011-220707 | A | 11/2011 |

OTHER PUBLICATIONS

International Search Report dated May 7, 2013, for International Patent Application No. PCT/JP2013/052808.

* cited by examiner (a) Joint carrying no accelerated airflow (b) Joint carrying accelerated airflow

PARTICLE SORTING MACHINE

This application is a National Phase application under 35 U.S.C. 371 of International Application No. PCT/JP2013/052808, filed on Feb. 7, 2013, which claims priority to Japanese provisional application No. 2012-073607, filed on Mar. 28, 2012; all of which are hereby incorporated by reference in their entireties.

TECHNICAL FIELD

The present invention relates to an airflow separator for separating particles with airflow, and is suitable for use in a recycling industry field and in a food/material field in which particle separation is performed.

BACKGROUND ART

There are many particle separators using airflow. Many of them are apparatuses for separating particles with a horizontal airflow into those to be flown away by air and those to fall down by an inertial force. Representative vertical separators are zigzag classifiers. Zigzag classifiers are apparatuses that separate particles into those to float upward in a zigzag column by being carried by airflow, and those to fall down. Zigzag classifiers hardly produce intermediate products and can realize fast separation, but have a slightly poor separation precision. Meanwhile, from the era of the former Agency of Industrial Science and Technology, the present applicant has consecutively explored techniques using a straight column and a straight column having a pinch (an orifice), and have filed many patent applications for such techniques (see PTLs 1 to 5).

PTL 1 relates to an airflow separation method and apparatus for solid matters, using a structure in which the first stage is not a column but is simply a fluid bed above a net, through which acicular matters are let to fall below the net, and the second stage is a column through which lump matters are separated into heavy products and light products.

PTL 2 relates to an airflow separation method and apparatus for solid matters, using two columns. First, the matters are fed into a first column for separating light products and intermediate products. Light products are discharged and recovered from the top of the first column, and intermediate products are let to fall down and slide over a net to be fed into a second column. Through the second column, they are separated into intermediate products and heavy products. In this patented technique, two blowers are used to send air individually to the two columns having a fixed cross-sectional area, the order to recover the products is light products first and intermediate products/heavy products next, and the products are let to move from the column to the column by gravitational fall above a net.

PTL 3 relates to a multi-stage wind-force separator that realizes multi-stages in one column by changing the diameter of the column stepwise with a diffuser. Because a plurality of columns are arranged coaxially, airflow is generated with one blower basically. However, because a wind speed ratio is generated between two columns with introduction of a second airflow, a plurality of blowers are necessary after all.

There are many common cyclone separators. They utilize a centrifugal force generated by a rotational flow, and convey minute particles together with air by carrying them on the rotational flow and separate them from heavy particles departed from the rotational flow. A wind-force separator of PTL 4 relates to an example in which a straight column airflow separator is combined with a cyclone in order to discharge intermediate products.

Further, PTL 5 presents an example of an airflow separator for solid matters, which is for the purposes of merely separating into three classes without asking a high precision, using an airflow separator with a straight column or an orifice-provided straight column.

CITATION LIST

Patent Literature—
PTL 1: Japanese Patent (JP-B) No. 2535778
PTL 2: JP-B No. 2757333
PTL 3: JP-B No. 4122438
PTL 4: JP-B No. 4096101
PTL 5: JP-B No. 2913034
PTL 6: Japanese Patent Application Laid-Open (JP-A) No. 2010-214352

SUMMARY OF INVENTION

Technical Problem

Previously, the present inventors have filed a patent application for a tantalum capacitor recycling method of PTL 6. PTL 6 relates to an invention of a tantalum capacitor recycling method including: a primary concentration step of stripping and recovering from used printed circuit boards, elements mounted on the boards, and separating the stripped recovered elements through a sieve, to thereby recover particles that are within the same dimension range as that of tantalum capacitors; a secondary concentration step of recovering particles that are within the same specific gravity range as that of tantalum capacitors from the primarily concentrated products by specific gravity separation; and a third concentration step of recovering non-magnetically attractable particles as highly concentrated tantalum capacitor products from the secondarily concentrated products by weak magnetic separation. A vertical airflow separator is used in the specific gravity separation of the secondary concentration step. In the invention described in PTL 6, in the secondary concentration step, the primarily concentrated products ranging from 2.8 mm to 4.75 mm are subjected to the vertical airflow separator, and separated in an ascending airflow having a flow rate of from 11 m/s to 14 m/s, such that light products having a specific gravity of 2.5 or less are overflowed and removed, and then separated in an (ascending) airflow having a flow rate of from 22 m/s to 24 m/s such that products having a specific gravity of 6.0 or greater are kept as heavy products, and intermediate specific gravity products are overflowed and recovered as secondarily concentrated products. Therefore, two batch operations using the vertical airflow separator are necessary. The present inventors have repeated earnest research and development for an airflow separator that can perform the secondary concentration step that has been performed with two batch operations, with only one operation, precisely, and without upsizing of the apparatus, and have reached the present invention.

Performances required of an airflow separator, related with the separator itself, except for those related with the type of targets such as an applicable particle diameter, include how high a high separation precision and a separation speed are, how many types of products can be separated, and how simple the apparatus is.

A straight column airflow separator can realize relatively high-precision separation compared with other airflow separators, because its wind speed distribution in the column, which is the threshold for separation, is relatively narrow. However, strictly speaking, its wind speed distribution in a cross-section of the column is such that the wind speed is high in the center and low in the periphery. Therefore, the threshold ranges in proportion to the range of the wind speed distribution, which degrades the separation precision.

Further, because a straight column airflow separator has a single wind speed (threshold) throughout the column, particles repeat ascending and descending, resulting in a relatively low separation speed compared with other airflow separators. As a method for curing this, there is a method of accelerating particles by providing an orifice (pinch) halfway of the column. However, with an orifice, the separation speed becomes high, but the wind speed becomes more non-uniform in a cross-section of the column, with an extremely high wind speed in the center of the cross-section of the column. In order to resolve this non-uniformity, it is necessary to make a portion of the straight column that is past the orifice long, which makes the column large-sized lengthwise, leading to upsizing of the apparatus.

Meanwhile, a straight column airflow separator or a zigzag airflow separator having a high separation precision performs two-component separation based on a single wind speed, into those that ascend by that wind speed and those that descend by that wind speed. There are also separators that perform separation into multiple components based on the leaping distance of particles by a single wind speed, but they cannot expect a high separation precision. To perform separation into three or more components with a straight column airflow separator while securing precision, a method of coupling a plurality of columns is employed. However, in such conventional methods, the apparatus becomes large because blowers are provided column by column for wind speed control.

An object of the present invention is to provide an airflow separator having an improved separation precision without loss of separation speed, and having a simple apparatus structure.

Another object of the present invention is to provide an airflow separator that performs separation into three or more components at a maintained separation precision, without loss of separation speed, and without upsizing of the apparatus.

Solution to Problem

To achieve the objects described above, an airflow separator of the present invention includes:

a first column into which a gas is introduced from a lower portion thereof and inside which a sample is made to flow;

a heavy particle recovery device provided at the lower portion of the first column; and a control device configured to control a wind speed by an amount of the gas to be introduced into the first column, wherein the first column is provided with a weak rotational flow generation mechanism, to smooth a wind speed distribution in a cross-section of a tube of the first column by making it substantially W-shaped from a portion of a wall of the tube, to a center of the tube, and to another portion of the wall of the tube wherein the heavy particle recovery device recovers from the sample, heavy particles that fall down, and wherein an emission gas, intermediate particles, and light particles are recovered from an upper portion of the first column.

The airflow separator of the present invention is characterized in that the weak rotational flow generation mechanism provided for the first column is a spiral structure provided on a circumferential surface of an internal wall of the tube of the first column, or a low-speed rotation impeller provided at the lower portion of the first column.

The airflow separator of the present invention includes a first column cross-sectional area changing mechanism configured to change a cross-sectional area of the first column by moving a portion of a surface of the wall of the first column, wherein the control device controls the first column cross-sectional area changing mechanism.

The airflow separator of the present invention further includes a second column, wherein the second column is connected to the upper portion of the first column via a joint, wherein all of the emission gas, the intermediate particles, and the light particles from the upper portion of the first column are sucked into the second column via the joint, wherein the second column is provided with a weak rotational flow generation mechanism, to smooth a wind speed distribution in a cross-section of a tube of the second column by making it substantially W-shaped from a portion of a wall of the tube, to a center of the tube, and to another portion of the wall of the tube, wherein an intermediate particle recovery device provided at a lower portion the second column recovers the intermediate particles that fall down, and wherein a light particle recovery device provided at an upper portion of the second column recovers the emission gas and the light particles from the upper portion of the second column, and discharges the emission gas.

The airflow separator of the present invention is characterized in that the weak rotational flow generation mechanism provided for the second column is a spiral structure provided on a circumferential surface of an internal wall of the tube of the second column, or a low-speed rotation impeller provided at the lower portion of the second column.

The airflow separator of the present invention includes a second column cross-sectional area changing mechanism configured to change a cross-sectional area of the second column by moving a portion of a surface of the wall of the second column, wherein the control device controls the second column cross-sectional area changing mechanism.

The airflow separator of the present invention is characterized in that with the joint connected to an opening formed in a circumferential wall of the tube of the second column in order to let the emission gas, the intermediate particles, and the light particles from the upper portion of the first column irrupt obliquely upward into the second column along a direction of an extension of the joint, and with the joint provided with an orifice to make a wind speed in the joint higher than a wind speed in the first column and convey the emission gas, the intermediate particles, and the light particles from the upper portion of the first column deeply into the second column, recovery of particles that fall down due to loss of speed immediately after irruption into the second column from the joint is prevented.

The airflow separator of the present invention includes retractable anemometers in the first column and the second column, respectively, wherein the retractable anemometers monitor the wind speed distribution in the cross-section of the tube of the columns, respectively.

The airflow separator of the present invention is characterized in that the control device includes a unit configured to store a separation database previously acquired, and is capable of making control operations by setting airflow separation conditions of the first column and the second column based on the separation database.

The airflow separator of the present invention is characterized in that the sample is primarily concentrated products obtained by recovering particles that are in the same dimension range as that of tantalum capacitors, from elements stripped and recovered from used printed circuit boards, and that the airflow separator recovers from the sample, particles that are in the same specific gravity range as that of the tantalum capacitors as the intermediate particles.

Advantageous Effects of Invention

With the present invention, it is possible to improve the separation precision, by using a weak rotational ascending airflow generated by producing a weak rotational airflow in an ascending airflow, because this makes the wind speed distribution in a cross-section of the column smooth.

With the present invention, it is possible to adjust the wind speed, by controlling the amount of a gas to introduce or the column cross-sectional area changing mechanism with the control device.

With the present invention, it is possible to save energy, by generating a weak rotational airflow with a spiral structure provided on the internal circumferential wall surface of the column, because this eliminates necessity for power for generating a weak rotational airflow.

With the present invention, when there are a first column and a second column, it is possible to vary the wind speeds between the columns by making the cross-sectional area of at least one column variable, and to thereby realize a desired wind speed ratio with one blower.

DESCRIPTION OF EMBODIMENTS

It has been discovered that when a weak rotational airflow is produced in a vertical ascending airflow in a straight column airflow separator, amazingly, the wind speed distribution in a cross-section of the column becomes more smoothed, and the separation precision is improved.

Figure 1A:
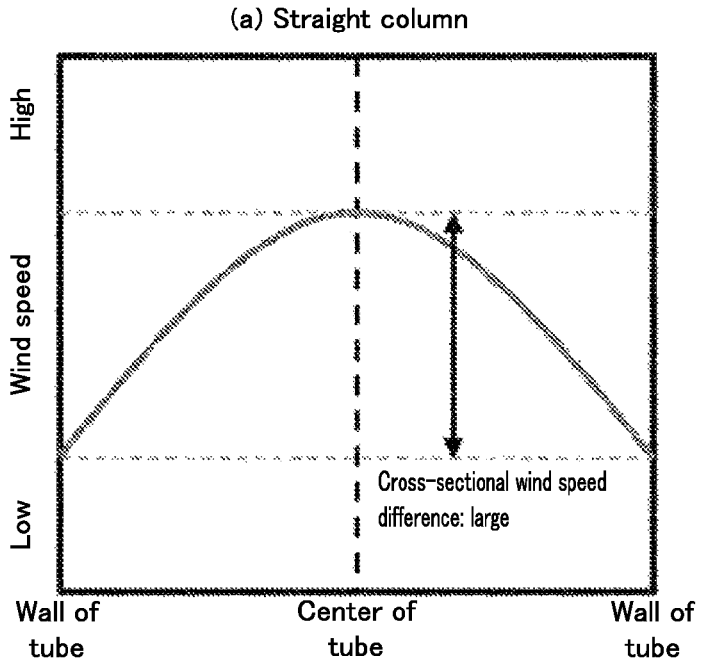
FIG. 1A is a diagram showing an image of a wind speed distribution of a conventional straight column ascending airflow in a cross-section of a column.

In a conventional straight column airflow separator using only a vertical ascending airflow, due to friction with the wall of the tube, an airflow ascending in the column has an upwardly-convex flow speed distribution shown in FIG. 1A in which the speed is higher in the center and lower in the periphery, as known from a so-called Poiseuille flow in a laminar flow region and 1/7 power rule in a turbulent flow region. This makes it likely that among particles of the same kind, a particle that happens to exist in the center of the tube ascends by the airflow, while a particle that happens to exist in the periphery of the tube falls down. This degrades the separation precision proportionately.

Figure 1B:
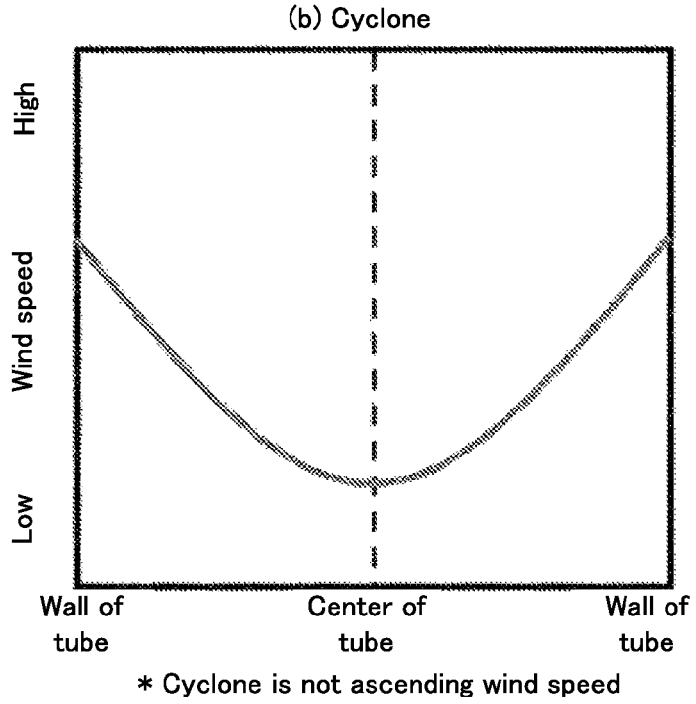
FIG. 1B is a diagram showing an image of a wind speed distribution of a conventional cyclone in a cross-section of a column.

Meanwhile, it is known that when air is let to flow in a vertical tube under a fast rotational airflow (cyclone), the flow speed becomes higher in the periphery than in the center, resulting in a downwardly-convex flow speed distribution shown in FIG. 1B.

Figure 1C:
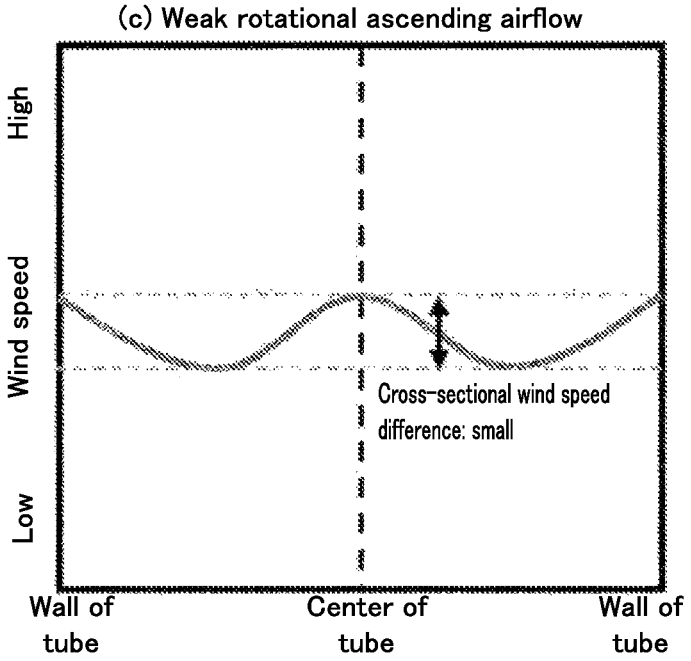
FIG. 1C is a diagram showing an image of a wind speed distribution of a weak rotational ascending airflow of the present invention in a cross-section of a column.

As compared with those above, a weak rotational ascending airflow of the present invention shown in FIG. 1C, which does not ascend vertically in the column, but flows upward in the column by making very weak rotations, shows a substantially W-shaped wind speed distribution shown in FIG. 1C under an effect averaging the two cases shown in FIG. 1A and FIG. 1B, showing a relatively uniform cross-sectional wind speed. That is, the flow speed distribution of the weak rotational ascending airflow of the present invention in a cross-section of the column (from a portion of the wall of the tube to the center of the tube, to another portion of the wall of the tube) is not like the upwardly-convex flow speed distribution shown in FIG. 1A, but is like the substantially W-shaped wind speed distribution shown in FIG. 1C with increased flow speeds at the wall of the tube and a reduced flow speed in the center of the tube. Cross-sectional wind speed differences in FIG. 1C are smaller than cross-sectional wind speed differences in FIG. 1A. Hence, the weak rotational ascending airflow of the present invention makes the wind speed distribution in a cross-section of the column smoother, and makes the separation precision better. In the present specification, a weak rotational ascending airflow means an ascending airflow rotating at a low speed, which ascends vertically by 10 or more times as great as the diameter of the column while making one rotation (circling) in the column.

For example, when obtaining an ascending airflow of 14.8 m/s in a column having an internal diameter of 90 mm, it is possible to obtain a wind speed distribution in which a cross-sectional wind speed is smooth, by applying extremely gentle circling of about from 4 to 5 r.p.s. (4 to 5 rotations per second), i.e., circling that would produce one rotation every time the airflow ascends by 3 m.

As a mechanism for generating such airflow, there are a method of gently rotating an impeller provided downward, a method of rotating the column itself, a method of providing a spiral structure in the column, a method of rotating the airflow in the tube by sending air into the tube through a spiral-stair-shaped screw-shaped object such as a non-rotational inclined blade or a static mixer, and a method of rotating the airflow in the tube by providing an air-sending nozzle inclined from a vertical direction on the internal wall of the column. An impeller may be any of a type having steep blades parallel with the vertical direction and a type having blades inclined from the vertical direction. The method for providing a spiral structure may be a method of pushing in a spiral structure such as a spring along the internal wall of the tube, a method of forming a spiral groove in the internal wall of the tube, and a method of attaching a flow regulation product such as a ribbon or a tape spirally on the internal wall of the tube. Among these generation mechanisms, the method of rotating an impeller and the method of rotating the column itself need a drive source separately, but the method of attaching a spiral structure needs no drive source and can save energy.

When there is any wind direction disturbance in the column before a rotational airflow is generated, it becomes harder for a precise weak rotational ascending airflow to be generated. Hence, it is effective to install a latticed flow regulator plate in front of any type of the mechanisms for generating a rotational airflow. A method for supplying a sample into the column may be selected according to the configuration of the weak rotational airflow generation mechanism described above. Hence, the sample may be supplied from below the column by being carried on an ascending airflow, or the sample may be supplied from obliquely above into a supply port in the side wall of the column by gravity fall, or both of these may be combined.

Figure 2A:
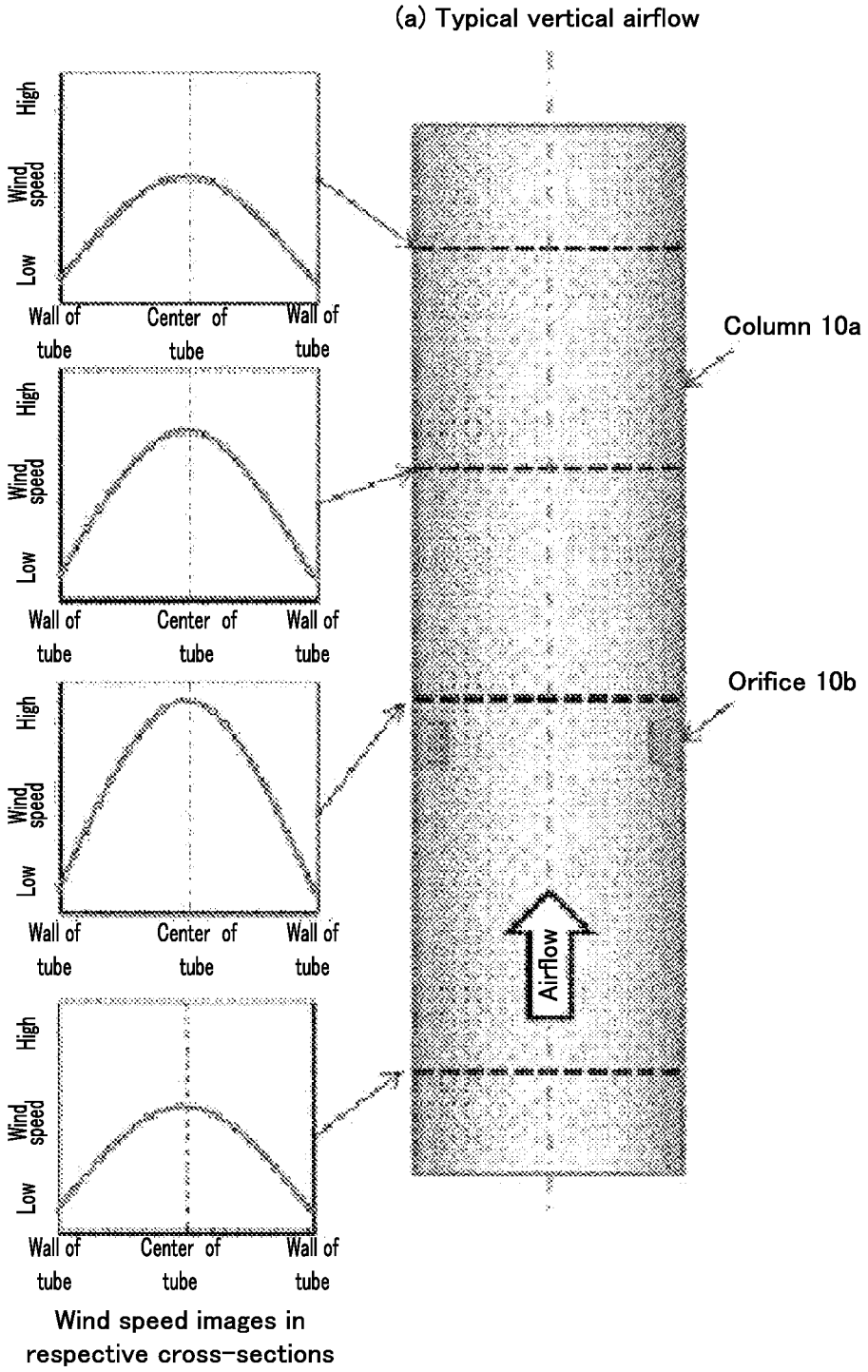
FIG. 2A is a diagram showing images of wind speed distributions of a typical vertical ascending airflow in cross-sections of a column, showing how the ascending speed is accelerated by passage through an orifice.

As described above, in an orifice-provided straight column airflow separator, the ascending speed is accelerated in the center of the column 10*a* by passage through the orifice (pinch) 10*b* in the column 10*a*, and a cross-sectional wind speed distribution immediately after the passage through the orifice 10*b* is such that the wind speed is extremely high in the center and low in the periphery, as shown in FIG. 2A. Hence, past the orifice, it takes a certain column length for the cross-sectional wind speed to regain a wind speed distribution typical in a straight column.

Figure 2B:
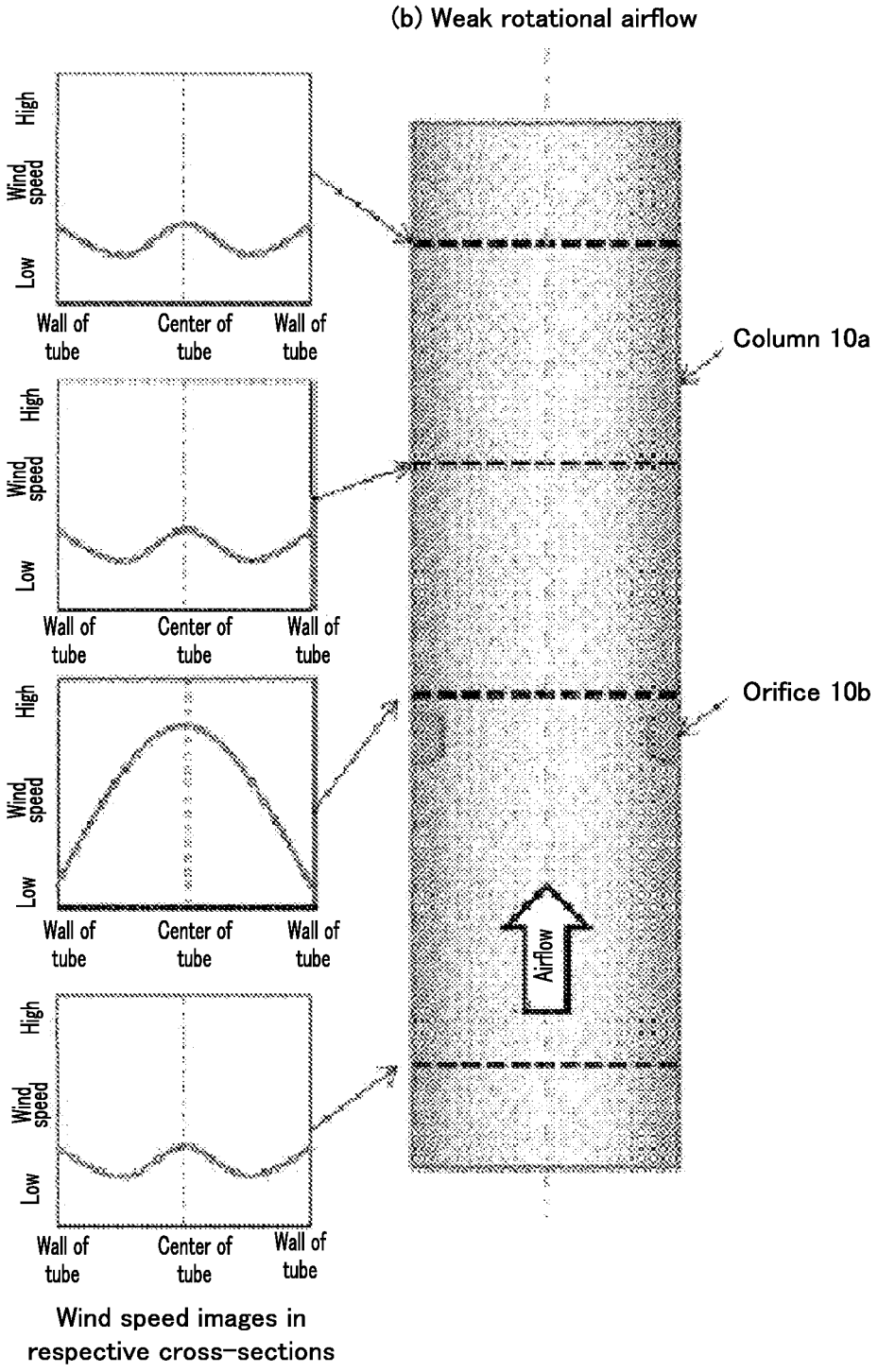
FIG. 2B is a diagram showing images of wind speed distributions of a weak rotational ascending airflow of the present invention in cross-sections of a column, showing how the ascending speed is accelerated by passage through an orifice.

However, under the weak rotational airflow of the present invention, air passes through the orifice 10*b* by making rotations, and quickly spreads toward the wall of the tube immediately after passed through the orifice 10*b*, quickly regaining a smooth cross-sectional wind speed as shown in FIG. 2B.

A comparison will be made between an orifice-provided straight column airflow separator using a typical vertical airflow and an orifice-provided straight column airflow separator using a weak rotational ascending airflow of the present invention, although they cannot be compared flatly because they are different in the fundamental cross-sectional wind speed distribution (which is smoother in the present invention). When obtaining an ascending airflow of 14.8 m/s in a column having an internal diameter of 90 mm and an internal diameter of 84 mm at the orifice, past the orifice, a column length of 20 cm is necessary under the typical vertical airflow in order to regain smoothness of the level in a typical straight column, whereas a column length of only 10 cm is necessary under the weak rotational ascending airflow in order to regain a very smooth wind speed distribution that is owing to the weak rotational ascending airflow. It should be noted, however, that on the condition that they use an orifice of the same internal diameter, the former has an acceleration effect owing to the orifice of 7% increase in the flow speed, whereas the latter has an acceleration effect of only 5% increase in the flow speed, i.e., the acceleration effect is slightly poorer.

To separate three kinds of products, namely heavy products (heavy particles), intermediate products (intermediate particles), and light products (light particles) with one airflow separator using a weak rotational ascending airflow, two straight columns are coupled, and one of the columns is fixed in the cross-sectional area whereas the other of the columns coupled to that column is made variable in the cross-sectional area in order to do with one blower for the two columns. The specifications may be as follows, for example.

Figure 3:
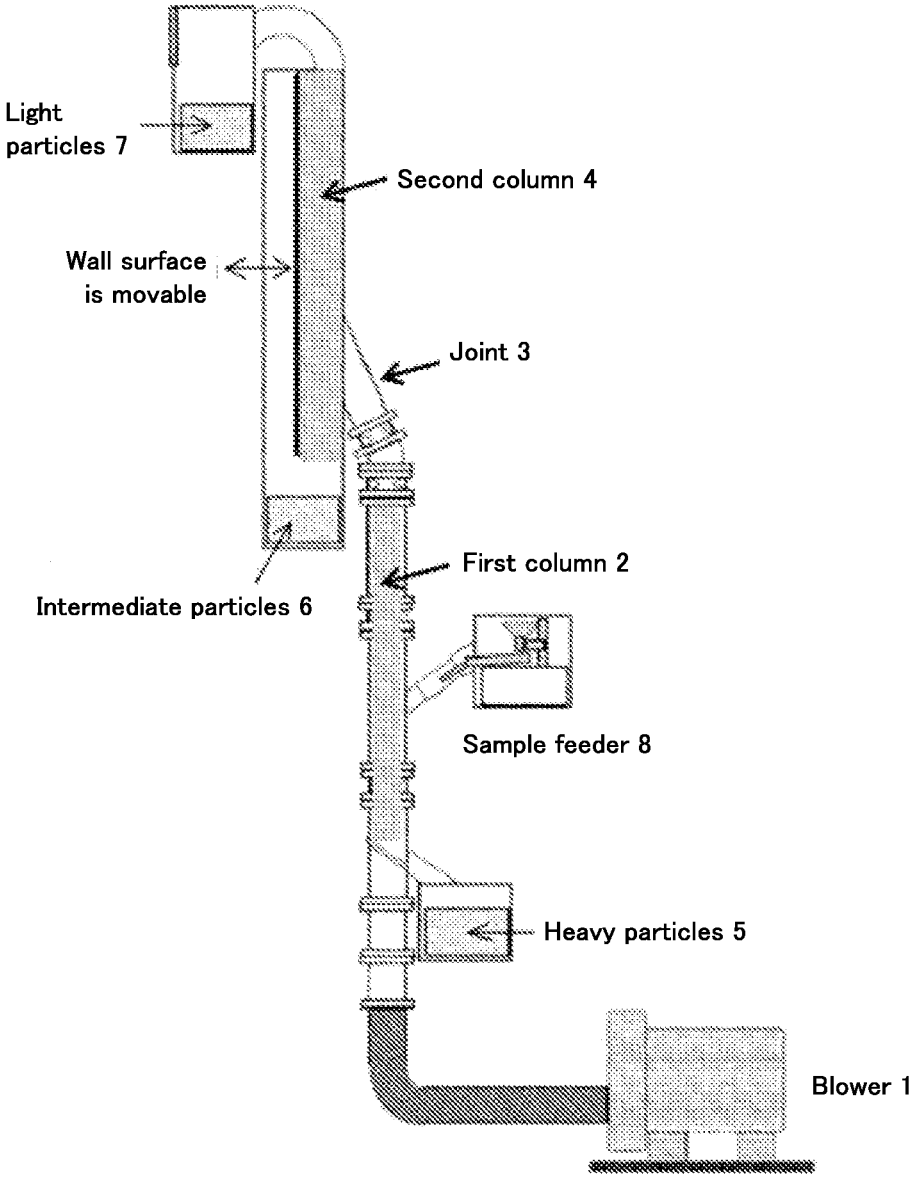
FIG. 3 is a diagram showing an outline of a two-stage column airflow separator of the present invention.

As shown in FIG. 3, a first column 2 is directly connected to a blower 1 and fixed in the cross-sectional area, and the wind speed thereof is controlled based on an amount of air to be introduced based on inverter control by the blower 1. The wind speed of a second column 4 coupled to the first column 2 via a joint 3 is controlled based on sucking of an emission gas from the first column 2 through the joint 3, and changing of the cross-sectional area of the second column 4. Although unillustrated, a spiral structure is attached on the internal circumferential surface of the wall of the tube of the first column 2 and the second column 4, in order to generate a weak rotational ascending airflow. In the generation, by performing smoothing of the cross-sectional wind speed, not by expanding/shrinking a rectangular cross-sectional shape by the length of the sides of the rectangle, but by expanding/shrinking a flat elliptical cross-sectional shape (like an athletics track field) formed of a straight portion and hemicycles by the length of the straight portion, it is possible to prevent the wind speed from being low on the four corners, and also to make the generation of the weak rotational ascending airflow easier.

With the weak rotational ascending airflow of the present invention provided with a substantially W shape in its wind speed distribution in a cross-section of the tube of the column from a portion of the wall of the tube to the center of the tube to another portion of the wall of the tube, the wind speed distribution in the cross-section of the column becomes smoother, and the separation precision is improved. Owing to this, although needless to say, the airflow separator can be used with a single column (i.e., with the first column 2 only), and in this case, the airflow separator may be provided with a cross-sectional area changing mechanism for changing the cross-sectional area. In FIG. 3, the blower 1 is directly connected below the first column 2 for the gas introduction. However, the gas introduction needs not necessarily be by the blower 1. Furthermore, sample supply needs not necessarily be by a sample supply device, but may be together with airflow when introducing a gas.

In the two-stage column airflow separator of the present invention, heavy particles 5 are recovered with the first column 2 on the first stage based on fall-down of the particles, an emission gas from the first column 2, intermediate particles 6, and light particles 7 are sent into the second column 4 on the second stage, and through the second column, the intermediate particles 6 are recovered based on fall-down thereof, and the light particles 7 are recovered together with an emission gas from the second column 4. That is, the wind speed is constantly adjusted such that it is higher in the first column than in the second column. The connection between the first column 2 and the second column 4 is made by connecting the joint 3 provided above the first column 2 to an opening formed in the circumferential wall of the tube of the second column 4, such that the emission gas and particles from the top of the first column 2 irrupt obliquely upward into the second column 4 along the direction of an extension of the joint. Here, if the first column 2 is connected to the second column 4 simply with the wind speed in the joint 3 maintained to the wind speed in the first column 2, a region in the second column 14 below the extension of the joint becomes wind calm, and particles irrupted into this region all lose speed and fall down, resulting in that light particles 7, which should not be recovered by right, are recovered as intermediate particles 6.

Figure 4A:
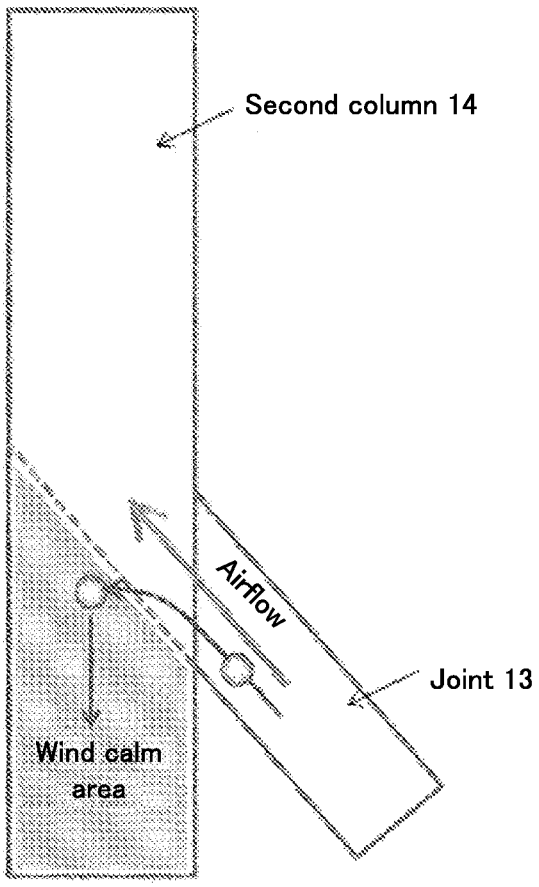
FIG. 4A is a diagram explaining an accelerated airflow in a conventional joint between two-stage columns that carriers no accelerated airflow.
Figure 4B:
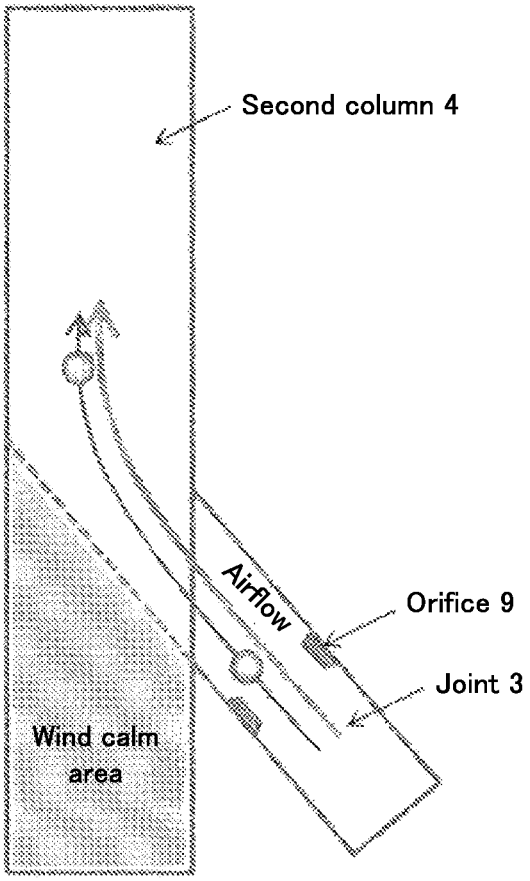
FIG. 4B is a diagram explaining an accelerated airflow in a joint between two-stage columns of the present invention that carriers an accelerated airflow due to an orifice.

Hence, the present invention sees to it that all particles, regardless of whether heavy or light, are conveyed deeply into the second column 14 such that they would be separated according to the wind speed in the second column 4, by providing the joint 3 with an orifice 9, by making the diameter of the joint tube smaller, or by introducing a second airflow as in PTL 3. FIG. 4B shows an example provided with an orifice 9. A reference sign 13 in FIG. 4A denotes the joint.

The airflow speeds in the first column 2 and the second column 4 are adjusted based on actual monitoring with an anemometer. In this case, it is possible to quickly make rough determinations of the wind speeds in the first column 2 and the second column 4, by previously making researches into the relationship between the frequency of inverter control by the blower 1 and, for example, the wind speed in the first column 2, and the relationship between the step number (forwarding distance) of a pulse motor for varying the cross-sectional area of the second column 4 and the cross-sectional area thereof, previously making the researched relationships into a separation database, and storing the database in a control system (a separation database storing unit) of the apparatus.

It is important to measure the wind speed not only from one arbitrary point in a column cross-section, but from a plurality of points in the cross-sectional direction continuously by shifting the position of the anemometer in the cross-sectional direction to thereby monitor the cross-sectional wind speed in the column and its being smoothed. Further, if the anemometer is stopped in the column, it becomes an obstacle for the actual separation. Therefore, it is also important to retract the anemometer after the monitoring is completed, and ensure that no protruding object remains on the internal wall of the column.

For airflow separation, there are a method of performing sucking from a gas discharging side, and a method of introducing air from a gas sucking side. The present invention mainly assumes the latter case. However, either method may be used to generate airflow in the column. However, when a supply feeder (e.g., a sample feeder 8 of FIG. 3) and a hopper connected to the supply feeder are opened systems, there would occur from there, air sucking in the former case, and air discharging in the latter case, which makes it harder for the wind speed in the column and a rotational ascending airflow to remain stable. In order for the apparatus of the present invention to maximize its effect, it is important to provide a hopper and a feeder that are charged with a separation sample in a certain amount as closed systems, and supply the sample continuously.

EXAMPLES

Separation into three kinds, namely light particles, intermediate particles, and heavy particles would be performed with the second-stage column airflow separator of the present invention, by controlling driving of the apparatus based on a separation database previously acquired. Unlike with an apparatus merely configured to separate heavy and light products into two components, it would be possible to directly recover, for example, only intermediate particles having an arbitrary specific gravity from a sample of mixed components classified based on size beforehand, with only one separation operation. Further, with previous inputting of a separation database about the targets, the user can let specific particles be recovered by simply inputting the product information such as the kind and size of the product. Hence, with the two-stage column airflow separator of the present invention, it would be possible to realize specific gravity separation of the secondary concentration step of the tantalum capacitor recycling method of PTL 6. The user would need only to input, for example, the size of the sample to feed, and the name of elements he/she would want to be recovered (e.g., tantalum capacitor), which would lead to automatic adjustment to optimum separation conditions, and whereby separation would be achieved.

As a result of subjecting a mixed element mock sample having a similar particle diameter and specific gravity to those of tantalum capacitors (i.e., extremely difficult to separate) to a test for condensing tantalum capacitors with a pilot model of the two-stage column airflow separator of the present invention, a tantalum capacitor grade (purity) of 14.2% before the test improved to a grade of 85.5% at a recovery rate of 91.4%, with a separation efficiency of 88.9%. This meant that although it being a continuous-type pilot model, the present apparatus acquired a precision similar to the level of the result described in PTL 6 in which a test was performed with a classical batch-type one-stage column laboratory model, meaning that the present invention was very practical.

Explanation was made above based on the case of obtaining three kinds of separation products, namely light particles, intermediate particles, and heavy particles, with two-stage columns. However, it is possible to obtain more kinds of separation products by increasing the number of column stages and configure a three or more-stage structure. Furthermore, needless to say, the present invention is applicable also to a batch operation.

INDUSTRIAL APPLICABILITY

The present invention has been developed mainly as an airflow separator in a recycling industry, but is applicable not only to a recycling industry but also to all fields in which airflow separation is performed, such as material control in a manufacturing industry.

REFERENCE SIGNS LIST

1 blower
2 first column
3, 13 joint
4, 14 second column
5 heavy particles
6 intermediate particles
7 light particles
8 sample feeder
9, 10*b* orifice
10*a* column

The invention claimed is:

1. An airflow separator, comprising:

a first column into which a gas is introduced from a lower portion thereof and inside which a sample is made to flow;

a heavy particle recovery device provided at the lower portion of the first column; and a control device configured to control a wind speed by an amount of the gas to be introduced into the first column, wherein the first column is provided with a weak rotational flow generation mechanism, to smooth a wind speed distribution in a cross-section of a tube of the first column by making it substantially W-shaped from a portion of a wall of the tube, to a center of the tube, and to another portion of the wall of the tube, wherein the weak rotational flow generation mechanism provided for the first column is a spiral structure provided on a circumferential surface of an internal wall of the tube of the first column, or a low-speed rotation impeller provided at the lower portion of the first column, whereby the weak rotational flow generation mechanism generates a weak rotational ascending airflow which ascends vertically by 10 or more times as great as the diameter of the column while making one rotation (circling) in the column, wherein the heavy particle recovery device recovers from the sample, heavy particles that fall down, and wherein an emission gas, intermediate particles, and light particles are recovered from an upper portion of the first column.

2. The airflow separator according to claim 1, comprising a first column cross-sectional area changing mechanism configured to change a cross-sectional area of the first column by moving a portion of a surface of the wall of the first column, wherein the control device controls the first column cross-sectional area changing mechanism.

3. An airflow separator comprising:

a first column into which a gas is introduced from a lower portion thereof and inside which a sample is made to flow;

a heavy particle recovery device provided at the lower portion of the first column; and a control device configured to control a wind speed by an amount of the gas to be introduced into the first column, wherein the first column is provided with a weak rotational flow generation mechanism, to smooth a wind speed distribution in a cross-section of a tube of the first column by making it substantially W-shaped from a portion of a wall of the tube, to a center of the tube, and to another portion of the wall of the tube, wherein the heavy particle recovery device recovers from the sample, heavy particles that fall down, and wherein an emission gas, intermediate particles, and light particles are recovered from an upper portion of the first column, wherein the airflow separator further comprises a second column, wherein the second column is connected to the upper portion of the first column via a joint, wherein all of the emission gas, the intermediate particles, and the light particles from the upper portion of the first column are sucked into the second column via the joint, wherein the second column is provided with a weak rotational flow generation mechanism, to smooth a wind speed distribution in a cross-section of a tube of the second column by making it substantially W-shaped from a portion of a wall of the tube, to a center of the tube, and to another portion of the wall of the tube, wherein the weak rotational flow generation mechanism provided for the second column is a spiral structure provided on a circumferential surface of an internal wall of the tube of the second column, or a low-speed rotation impeller provided at the lower portion of the second column, whereby the weak rotational flow generation mechanism generates a weak rotational ascending airflow which ascends vertically by 10 or more times as great as the diameter of the column while making one rotation (circling) in the column, wherein an intermediate particle recovery device provided at a lower portion of the second column recovers the intermediate particles that fall down, and wherein a light particle recovery device provided at an upper portion of the second column recovers the emission gas and the light particles from the upper portion of the second column, and discharges the emission gas.

4. The airflow separator according to claim 3, comprising:

a second column cross-sectional area changing mechanism configured to change a cross-sectional area of the second column by moving a portion of a surface of the wall of the second column, wherein the control device controls the second column cross-sectional area changing mechanism.

5. The airflow separator according to claim 3, wherein with the joint connected to an opening formed in a circumferential wall of the tube of the second column in order to let the emission gas, the intermediate particles, and the light particles from the upper portion of the first column irrupt obliquely upward into the second column along a direction of an extension of the joint, and with the joint provided with an orifice to make a wind speed in the joint higher than a wind speed in the first column and convey the emission gas, the intermediate particles, and the light particles from the upper portion of the first column deeply into the second column, recovery of particles that fall down due to loss of speed immediately after irruption into the second column from the joint is prevented.

6. The airflow separator according to claim 3, comprising:

retractable anemometers in the first column and the second column, respectively, wherein the retractable anemometers monitor the wind speed distribution in the cross-section of the tube of the columns, respectively.

7. The airflow separator according to claim 3, wherein the control device comprises a unit configured to store a separation database previously acquired, and is capable of making control operations by setting airflow separation conditions of the first column and the second column based on the separation database.

8. The airflow separator according to claim 3, wherein the sample is primarily concentrated products obtained by recovering particles that are in a same dimension range as that of tantalum capacitors, from elements stripped and recovered from used printed circuit boards, and, wherein the airflow separator recovers from the sample, particles that are in a same specific gravity range as that of the tantalum capacitors as the intermediate particles.

* * * * *